US009907714B2

(12) United States Patent
Malvestio

(10) Patent No.: US 9,907,714 B2
(45) Date of Patent: Mar. 6, 2018

(54) BED FOR HOSPITAL STAY

(71) Applicant: MALVESTIO S.P.A., Villanova di Camposampiero (IT)

(72) Inventor: Marino Malvestio, Padua (IT)

(73) Assignee: MALVESTIO S.P.A., Villanova di Camposampiero (IT)

( * ) Notice: Subject to any disclaimer, the term of this patent is extended or adjusted under 35 U.S.C. 154(b) by 0 days.

(21) Appl. No.: 15/519,527

(22) PCT Filed: Oct. 9, 2015

(86) PCT No.: PCT/EP2015/073446
§ 371 (c)(1),
(2) Date: Apr. 14, 2017

(87) PCT Pub. No.: WO2016/058949
PCT Pub. Date: Apr. 21, 2016

(65) Prior Publication Data

US 2017/0239112 A1 Aug. 24, 2017

(30) Foreign Application Priority Data

Oct. 14, 2014 (IT) ..... PD2014A0266

(51) Int. Cl.
*A61G 7/015* (2006.01)

(52) U.S. Cl.
CPC ..... *A61G 7/015* (2013.01)

(58) Field of Classification Search
CPC ..... A61G 7/015; A61G 13/08
See application file for complete search history.

(56) References Cited

U.S. PATENT DOCUMENTS 4,996,731 A 3/1991 Kruyt
5,127,034 A * 6/1992 Wright ..... A61G 7/002 378/209
5,469,591 A * 11/1995 Nomura ..... A47C 20/04 5/191
5,537,701 A * 7/1996 Elliott ..... A47C 19/005 5/616

(Continued)

FOREIGN PATENT DOCUMENTS

EP 2601926 A1 6/2013
GB 1259181 A 1/1972

OTHER PUBLICATIONS

International Search Report dated Jan. 12, 2016 re: Application No. PCT/EP2015/073446; pp. 1-3; citing: U.S. Pat. No. 4,996,731 A, GB 1 259 181 A, US 2002/178502 A1 and EP 2 601 926 A1.

(Continued)

*Primary Examiner* — Eric J Kurilla
(74) *Attorney, Agent, or Firm* — Cantor Colburn LLP

(57) ABSTRACT

A bed for hospital stays, of the type that can be articulated and comprising a plurality of sections which correspond to the regions of the back, buttocks, thighs and legs of the in-patient; one of the sections, the one that corresponds to the buttocks region, has at least one portion thereof which is movable and articulated to the section of the backrest and, when the backrest is lifted, is translated, exposing a curved element, which extends from the lying surface downwardly, and being inclined on the curved element contributes together with it to form a cradle for the buttocks region.

4 Claims, 3 Drawing Sheets

(56) References Cited

U.S. PATENT DOCUMENTS

| | | | | |
|---|---|---|---|---|
| 2002/0178502 | A1 | 12/2002 | Beasley et al. | |
| 2005/0039263 | A1* | 2/2005 | Reed | A47C 1/03211 5/618 |
| 2016/0029807 | A1* | 2/2016 | Nomura | A61G 7/015 5/412 |
| 2016/0120718 | A1* | 5/2016 | Shimada | A61G 7/005 5/618 |
| 2017/0135881 | A1* | 5/2017 | Franceschetti | A61G 7/018 |
| 2017/0172827 | A1* | 6/2017 | Schaaf | A61G 7/018 |
| 2017/0196743 | A1* | 7/2017 | Wiggermann | G06F 19/3431 |

OTHER PUBLICATIONS

Written Opinion dated Jan. 12, 2016 re: Application No. PCT/EP2015/073446; pp. 1-5; citing: U.S. Pat. No. 4,996,731 A, GB 1 259 181 A, US 2002/178502 A1 and EP 2 601 926 A1.

* cited by examiner

BED FOR HOSPITAL STAY

TECHNICAL FIELD

The present invention relates to a bed for hospital stays.

BACKGROUND

Nowadays numerous types of beds for hospital stays are known in which sections of the bed surface are adjustable at the upper and lower parts of the back, at the thighs and at the legs, in order to allow the elevation of the backrest or of the leg rest with an electric or manual system.

Such beds are essential for patients with reduced motor capacity; however, very often the forward inclination of the backrest, in order to facilitate the sitting positioning of the patient, causes the patient to slip toward the footboard of the bed. Nowadays this is seen as an important problem to be solved for the health of the patient, who must be continuously repositioned in order to reduce compression in the chest region and of the pelvis, in order to facilitate respiration and improve postural comfort.

In an attempt to solve this problem, solutions have been devised with a backrest that can be moved by roto-translation: while the rotation results in the lifting of the backrest, simultaneously the translation results in its retraction, toward the headboard of the bed, so as to compensate the thrust of the patient toward the footboard.

However, to date this solution has not been found to be sufficient to solve the problem, because the patient seated on the bed is still subject over time to sliding toward the footboard, and the need is therefore felt to identify an improvement.

BRIEF SUMMARY

The aim of the present invention is to provide a bed for hospital stays which is capable of improving the comfort of the patients when they are shifted by lifting from the supine position to a sitting position which is supported by the backrest of the bed, while reducing the phenomenon of slipping toward the footboard of the bed.

Within this aim, a bed is provided capable of ensuring that the patient remains in the desired position for the entire time in which the backrest of the bed is inclined.

More particularly, the disclosure provides a bed for hospital stays, of the type that can be articulated and comprises a plurality of sections which correspond to the regions of the back, buttocks, thighs and legs of the in-patient, characterized in that one of said sections, the one that corresponds to the buttocks region, has at least one portion thereof which is movable and articulated to the section of the backrest and which, when said backrest is lifted, is translated, exposing a curved element, which extends from the lying surface downwardly, being inclined on said curved element and contributing together with it to form a cradle for the buttocks region.

BRIEF DESCRIPTION OF THE DRAWINGS

Further characteristics and advantages of the invention will become better apparent from the description of a preferred, but not exclusive, embodiment of a bed according to the invention, which is illustrated by way of non-limiting example in the accompanying drawings wherein.

DETAILED DESCRIPTION

Figure 1:
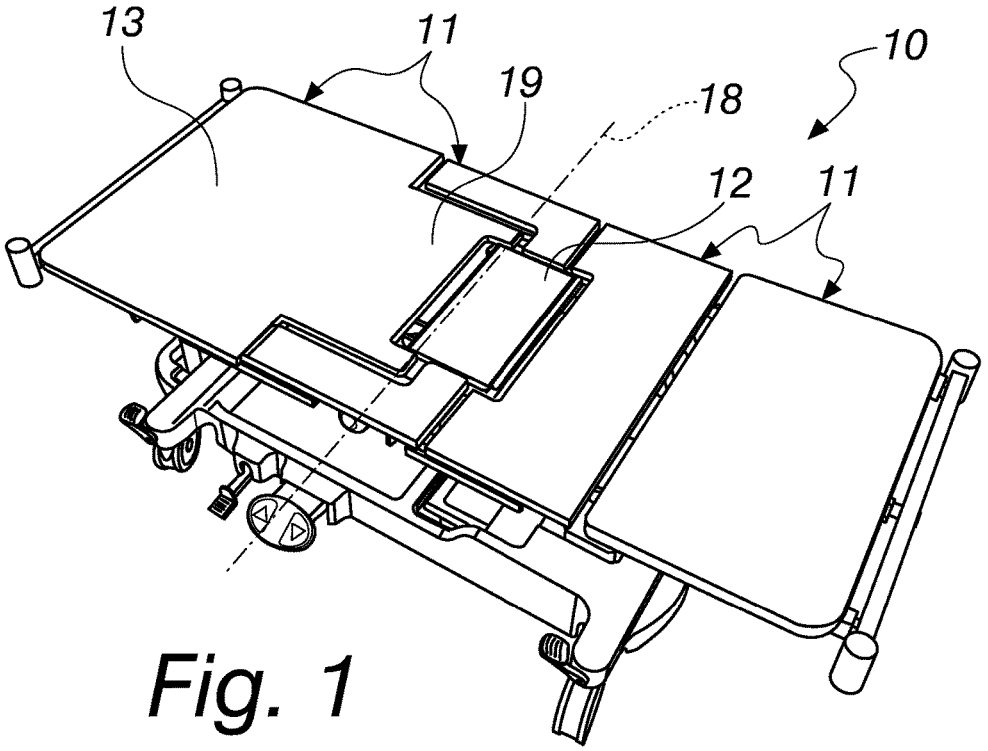
FIG. 1 is a perspective view of a bed according to the invention in a flat configuration.

With reference to the figures, the bed according to the invention is generally designated with the reference numeral 10.

The bed is of the type that can be articulated and comprises a plurality of sections 11 which correspond to the regions of the back, buttocks, thighs and legs of the in-patient.

In particular, one of the sections 11, the one that corresponds to the buttocks region, has at least a portion 12 thereof which is movable and articulated to the section 11 of the backrest 13.

Figure 2:
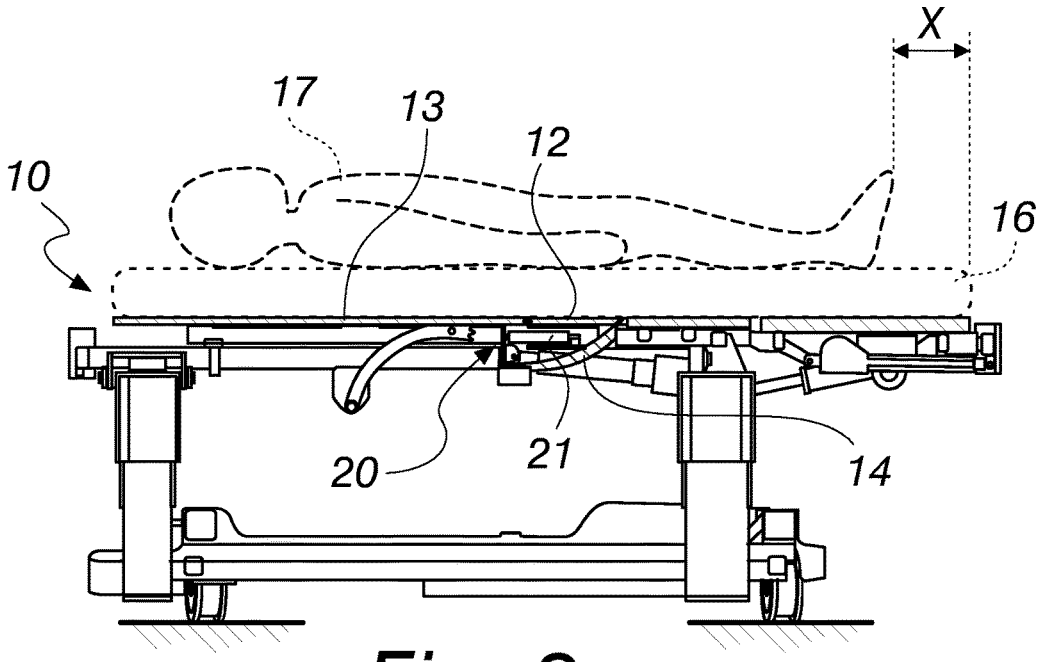
FIG. 2 is a sectional side view of the bed according to the invention in the same configuration as in FIG. 1.

FIG. 1 and FIG. 2 show the bed 10 in a flat configuration, in which both the portion 12 and the backrest 13 are arranged according to the lying surface.

Below the lying surface, at the portion 12, there is a curved element 14 which extends from the lying surface downwardly. When the backrest 13 is lifted, as in the configurations shown in FIGS. 3 to 6, the portion 12 is translated, exposing the curved element 14 and, by inclining thereon, contributes with it to form a cradle 15 for the buttocks region.

Figure 3:
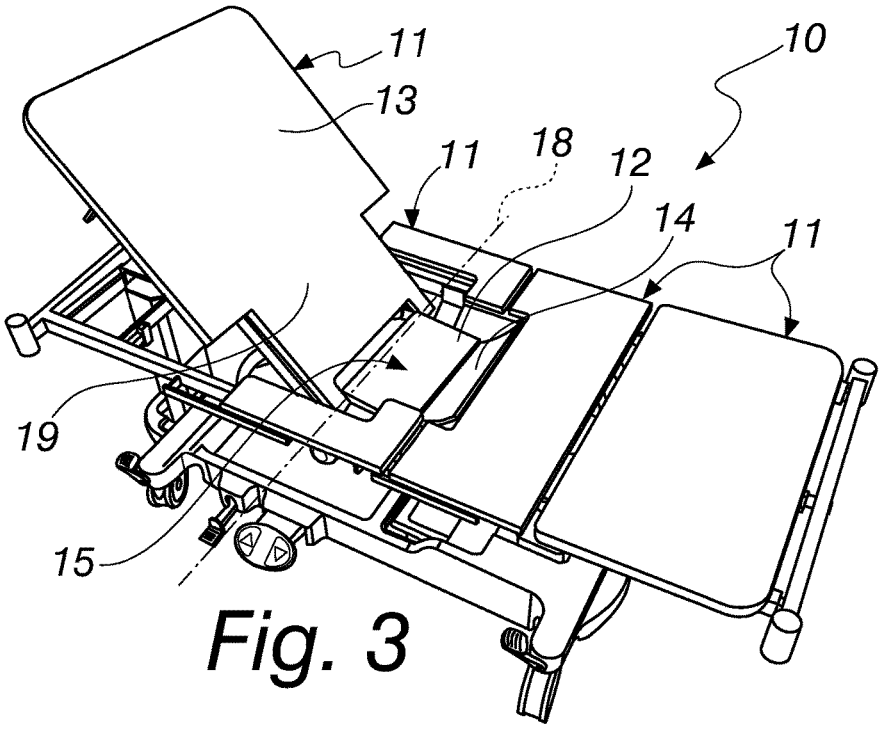
FIG. 3 is a perspective view of the bed according to the invention with the backrest inclined.
Figure 4:
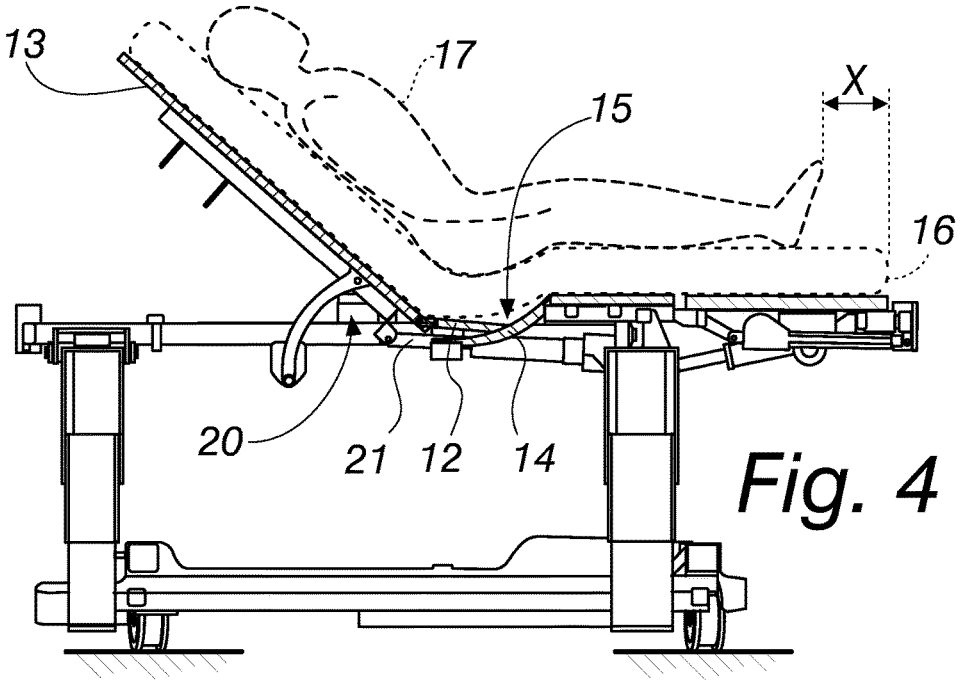
FIG. 4 is a sectional side view of the bed according to the invention in the same configuration as in FIG. 3.
Figure 5:
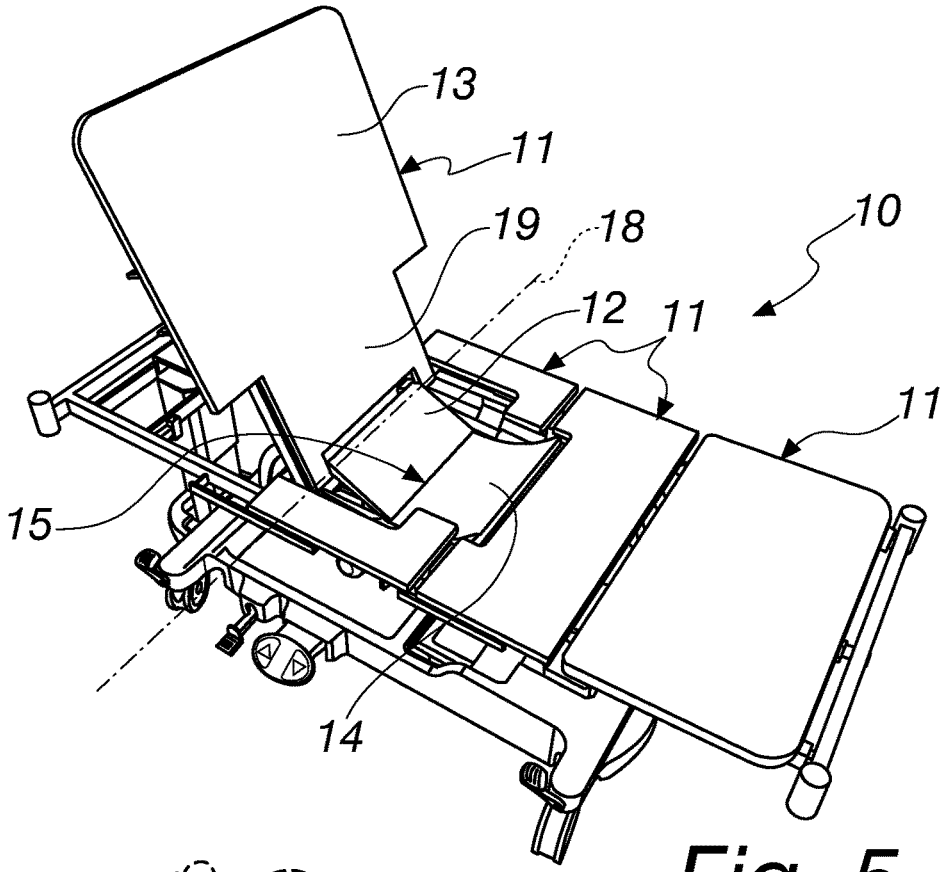
FIG. 5 is a perspective view of the bed according to the invention with the backrest inclined further than in FIGS. 3 and 4.
Figure 6:
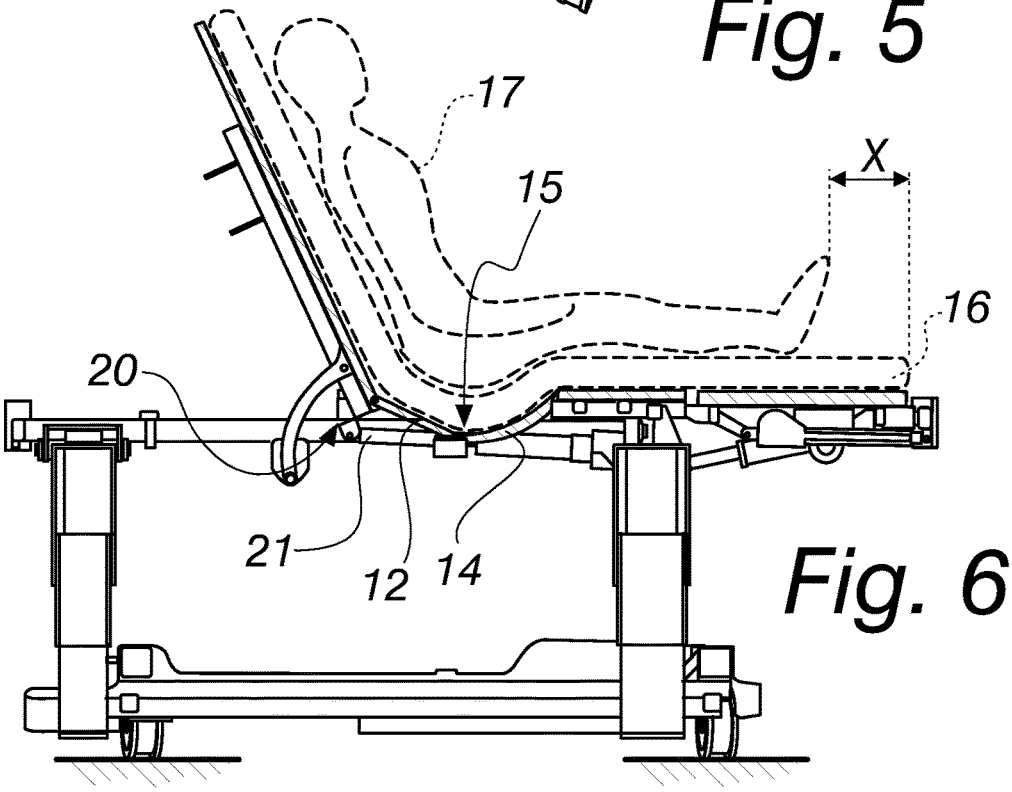
FIG. 6 is a sectional side view of the bed according to the invention in the same configuration as in FIG. 5.

FIG. 3 and FIG. 4 show the bed 10 with the backrest 13 inclined by approximately 40°, while in the subsequent FIGS. 5 and 6 the backrest 13 is inclined by approximately 70°. By comparing these two configurations, it can be seen that the cradle 15 is deeper for greater inclinations of the backrest 13.

In the lateral sections shown in FIGS. 2, 4 and 6 the bed 10 is covered by a mattress 16 of adapted shape and characteristics and thereon the shape 17 of a human being is shown, in order to show the positioning of the body on the sections of the bed 10, and in particular at the cradle 15.

As can be seen from the figures, the backrest 13 can rotate during lifting and lowering and is translatable toward the headboard, and the portion 12 is pivoted thereto, about a corresponding pivoting axis 18 which is transverse to the main direction of extension of the bed 10, and on the opposite side with respect to the pivoting side it is free and rests against the curved element 14.

As the portion 12 is pivoted to the backrest 13, it is entrained by it in retraction toward the headboard, revealing the curved element 14.

In the exemplary bed 10 shown, the backrest 13 comprises a lumbosacral portion 19 which is narrower than the resting surface of the bed 10, and to which the portion 12, which is also narrower, is pivoted. In this manner the cradle 15 is substantially delimited not only in length but also in width.

As shown in the figures in cross-section, the backrest 13 is conveniently movable by way of a kinematic mechanism 20, conventional, which is associated with actuation means 21, which, as illustrated, can consist of actuators, preferably electric.

The bed 10 is also provided with means of translation of the backrest 13 upwardly, which are adapted to act during the rotation thereof.

Use of the bed, according to the invention, is the following.

The bed 10 can be used in the flat configuration for the in-patient to rest in the supine position, or it can be brought to a configuration whereby the backrest 13 is inclined, passively shifting the in-patient to a sitting position.

In this case, one acts in a known manner, for example by way of a keypad, on the actuation means 21, which activate the kinematic mechanism 20 capable of lifting the backrest 13.

While the backrest 13 rotates, being lifted at the end where the head is rested, at the same time it is made translate toward the headboard, entraining with it the portion 12 which is pivoted thereto, which is therefore capable of assuming a different inclination from that of the backrest 13.

In moving back toward the headboard, the portion 12, which rests against the curved element 14 on the opposite side with respect to the pivoting side, inclines progressively, on the curved element 14, forming together with the latter the cradle 15 for the buttocks region, as illustrated with the shape 17.

It should be noted that in this manner the distance indicated with X in FIGS. 2, 4 and 6, which is the distance between the foot of the in-patient and the end of the mattress 16 at the footboard end, remains constant during the movement of the backrest 13.

The cradle 15 has in fact a resting surface with a curvature extending below the lying surface, on which the legs rest, thus preventing the body of the in-patient from sliding toward the footboard.

The initial thrust toward the footboard, owing to the movement of the backrest 13, is immediately limited by the simultaneous retraction toward the headboard, while, according to the above explanation, the slipping of the in-patient who is now in the sitting position is prevented by the presence of the cradle 15.

In this manner the patient does not have to be continuously repositioned and posture is improved.

In practice it has been found that the invention fully achieves the intended aim, by providing a bed for hospital stays which is capable of preventing the slipping of the in-patient toward the footboard when the backrest is inclined, and is therefore also more comfortable for the time the patient remains in the sitting position.

The invention, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. PD2014A000266 (102014902300901) from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

The invention claimed is:

1. An articulated bed for hospital stays comprising: multiple sections comprising at least one backrest, one buttocks section, one thighs section and one legs section which correspond respectively to the regions of back, buttocks, thighs and legs of an in-patient, wherein the buttocks section has at least one portion which is movable and articulated to the backrest and which, when said backrest is lifted, is translated exposing a curved element; said curved element extending from a lying surface downwardly and, when said backrest is lifted, said at least one portion being inclined on said curved element and contributing together with it to form a cradle for the buttocks section.

2. The bed according to claim 1, wherein said at least one portion is pivoted to said backrest about a pivoting axis transverse to a main direction of extension of said bed, and on an opposite side with respect to a pivoting side it is free and rests against said curved element.

3. The bed according to claim 2, wherein said backrest can be moved for lifting and translation by way of a kinematic mechanism associated with an actuation component and said at least one portion can translate, entrained by said backrest, by being pivoted thereto.

4. The bed according to claim 1, wherein said backrest comprises a lumbosacral portion to which said at least one portion is pivoted; both said lumbosacral portion and said at least one portion being narrower than a resting surface of said bed.

* * * * *